US006220126B1

(12) United States Patent
Domenge

(10) Patent No.: US 6,220,126 B1
(45) **Date of Patent: *Apr. 24, 2001**

(54) HAND TOOL HAVING PIVOTED HANDLES

(76) Inventor: Alberto G. Domenge, Fuente de las Aguilas 194, Tecamachalco 53950 Edo, de Mex. (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/126,734

(22) Filed: Jul. 31, 1998

(51) Int. Cl.[7] ..... B25B 7/02
(52) U.S. Cl. ..... 81/418; 81/421; 81/424
(58) Field of Search ..... 81/418, 305, 419, 81/421, 424, 426.5, 385, 394, 407, 405

(56) References Cited

U.S. PATENT DOCUMENTS

| | | | |
|---|---|---|---|
| 455,694 | | 7/1891 | Steltz . |
| 519,550 | | 5/1894 | Riordan . |
| 573,548 | | 12/1896 | Sours . |
| 823,367 | | 6/1906 | Ryan . |
| 1,194,058 | | 8/1916 | Neumayer . |
| 1,334,965 | | 3/1920 | Ridings . |
| 1,393,399 | * | 10/1921 | Schlehr ..... 81/418 |
| 1,445,908 | | 2/1923 | Perkins . |
| 1,526,761 | | 2/1925 | Robinson . |
| 1,668,474 | | 5/1928 | Wells . |
| 1,891,865 | | 12/1932 | Beck . |
| 1,915,404 | | 6/1933 | Clifton . |
| 2,173,215 | | 9/1939 | Shover . |
| 2,324,415 | | 7/1943 | Moss . |
| 2,464,145 | | 3/1949 | Mead . |
| 2,543,922 | | 3/1951 | Mead . |
| 2,558,440 | | 6/1951 | Johnson . |
| 2,584,353 | | 2/1952 | Keiser . |
| 2,779,224 | | 1/1957 | Coggburn . |
| 2,815,777 | | 12/1957 | Iraids . |
| 2,905,038 | | 9/1959 | Paden . |
| 3,312,988 | | 4/1967 | Shannon . |
| 3,585,704 | | 6/1971 | Schroeder . |
| 3,635,107 | | 1/1972 | Schmidt . |
| 3,672,245 | | 6/1972 | Hoffman . |
| 3,807,718 | | 4/1974 | Sendoykas . |
| 4,091,696 | | 5/1978 | Wahlberg . |
| 4,147,077 | | 4/1979 | Tasato . |
| 4,546,680 | | 10/1985 | Petersen . |
| 4,569,260 | | 2/1986 | Henry . |
| 4,601,221 | | 7/1986 | Kalkbrenner et al. . |
| 4,730,524 | | 3/1988 | Peterson . |
| 4,926,685 | | 5/1990 | Shannon, Sr. . |
| 5,007,312 | | 4/1991 | Bailey . |
| 5,022,291 | | 6/1991 | McBain . |
| 5,255,579 | | 10/1993 | Fortin . |
| 5,305,667 | | 4/1994 | Caballero . |
| 5,531,141 | | 7/1996 | Gilbert, Jr. . |
| 5,595,098 | | 1/1997 | Malkin et al. . |

* cited by examiner

*Primary Examiner*—Timothy V. Eley
*Assistant Examiner*—Willie Berry, Jr.
(74) *Attorney, Agent, or Firm*—Greenblum & Berstein, P.L.C.

(57) ABSTRACT

A hand tool is provided that includes at least two elongated members pivotally interconnected by a pivot joint to provide a pair of handles and a pair of jaw carrying members. Each jaw carrying member includes a self-adjusting jaw pivotally connected thereto, which is configured to have an angle-shape, whereby operation of the handle causes engagement of a multi-sided workpiece by the angle-shaped jaws to enable firm engagement with a workpiece and imparting of a rotational force or torque thereto.

7 Claims, 11 Drawing Sheets

HAND TOOL HAVING PIVOTED HANDLES

BACKGROUND OF THE INVENTION

1. Field of the Invention

This invention relates to a pivoted handled tool for grasping, holding or cutting workpieces having various configurations.

2. Description of Background Information

It is known, for example in U.S. Pat. No. 5,022,291 to McBain, to provide a pivoted handle tool having at least one pivotable jaw for engagement with a workpiece having a range of different sizes, such as nuts or bolts. The pivotable jaws have flat planar surfaces opposing one another, and the handles include an adjustable pivotable connection to enable the hand tool to engage a plurality of different sized fasteners. However, the flat planar surfaces of the jaws do not permit sufficient engagement with the outer surfaces of the nut such that when a turning force is applied by the hand tool of McBain, the tool can readily slip off the fastener or cause the outer surfaces to become rounded thereby rendering removal or installation of the fastener to be difficult if not impossible.

Another conventional hand tool having pivoted handles and including a locking feature is shown in U.S. Pat. No. 4,601,221 to Kalkbrenner et al., which discloses a clamping device for rectangular configurations that includes two opposed jaws each having a pivotally mounted, right-angled jaw portion which form a self-adjusting rectangular opening for engaging and holding a rectangular workpiece. The jaws are disclosed as engaging only square or rectangular workpieces and the jaws encompass the entire perimeter of those workpieces or the entire perimeter of an arrangement of a plurality of rectangular workpieces that are desired to be clamped together. It is clear that the self-adjusting jaws disclosed in Kalkbrenner et al. are not intended to engage the heads of threaded fasteners for applying a rotational force or torque thereto.

Conventional locking pliers are disclosed in U.S. Pat. No. 3,635,107 to Schmidt. The locking pliers disclosed herein include fixed planar jaw portions, with or without toothed segments, fixed curved jaw portions including toothed segments and combinations of fixed planar and toothed segments. However, there is no disclosure of a self-adjusting pivoted jaw for engagement of a multi-sided workpiece to apply a rotational force or torque thereto, nor is there disclosure of the pivoted jaws being formed with cutting segments, or of a locking pliers having two jaw members pivotally attached to one elongated member to provide a greater range of movement.

Additionally, U.S. Pat. No. 2,464,145 to Mead and U.S. Pat. No. 2,558,440 to Johnson both disclose hand tools having pivoted handles which include a slot formed in one of the handles at the pivotal connection to permit the hand tool to accommodate workpieces of various sizes. However, neither of these conventional pivoted handle tools provide an adjustment slot in both of the pivoted members to permit greater adjustability and accommodation of workpieces having larger sizes.

SUMMARY OF THE INVENTION

The present invention overcomes deficiencies in the prior art relative to the ability of the jaws of a hand tool having pivoted handles to maintain sufficient contact with a multi-sided workpiece, such as a hexagonal fastener, for example a nut or bolt, when a rotational force or torque is applied.

This results in an increased ability of the pivoted handle hand tool to apply a sufficient rotational force or torque to the workpiece and to provide proper engagement therewith to prevent rounding or other damage.

Furthermore, a hand tool embodying the pivoting self-adjusting jaws of the present invention enjoys enhanced engagement of a multi-sided workpiece, such as a hexagonal fastener, by providing engagement on four sides of the fastener with the jaw surfaces. Accordingly, the torquing capacity of the hand tool is increased, as is the ability of the tool to effectively engage and rotate a hexagonal fastener having worn or rounded surfaces as well as an undamaged hexagonal fastener.

Additionally, the present invention overcomes the deficiency in prior art toggle-link type hand tools by providing the pivotally interconnected jaws with cutting surfaces to facilitate gripping and cutting of work pieces thereby, and by providing a pair of pivotally interconnected jaw members on elongated members for increased efficiency in the actuation thereof.

According to a first aspect of the present invention, the hand tool is provided that includes at least two elongated members pivotally interconnected by a pivot joint to provide a pair of handles and a pair of jaw carrying members. Each jaw carrying member includes a self-adjusting jaw pivotally connected thereto, and each self-adjusting jaw is configured to have an angle-shape whereby operation of the handle causes engagement of a multi-sided workpiece by the angle-shaped jaws to enable firm engagement with a workpiece and imparting of a rotational force or torque thereto. Each angle-shaped jaw may be configured to engage two sides of a hexagonal fastener, and the pivot joint may be configured as a slip joint.

According to a further aspect of the invention, the slip joint may include a slot formed in at least one of the elongated members, and the slot includes at least two adjusting notches therein. A pin for pivotally interconnecting the elongated members is mounted on the other of the elongated members, and is movable within the slot from one adjusting notch to the other, thereby permitting adjustment of jaw spacing to accommodate different size fasteners. Additionally, the slot may be provided with more than two adjusting notches to permit greater adjustability of the hand tool.

According to another aspect of the invention, the hand tool is configured to have a second slot formed in the other of the elongated members, with the second slot having at least two adjusting notches therein. Furthermore, the pin for interconnecting the elongated members is rotatably mounted and is configured to have a D-shaped cross-section, whereby the pin is rotatable to align the flat side of the D-shape with a longitudinal dimension of each of the slots to permit sliding movement of both elongate members relative to one another to provide adjustment and to position the curved side of the pin within the respective notches to prevent relative pivoting of the elongated handles to allow operation of the hand tool.

Additionally, one end of the rotatable pin may be provided with a head, and the other end of the rotatable pin may be provided with a knurled knob to facilitate rotation of the pin to a desired position. Furthermore, each of the slots may be provided with more than two adjusting notches to permit greater adjustability of the hand tool.

Moreover, the pivoted handle tool may further include an angle-shaped self-adjusting jaw pivotally mounted to each of the elongated members for engagement with a multi-sided workpiece, and in particular each angle-shaped self-adjusting jaw may be configured to engage two adjacent sides of a hexagonal fastener.

According to another aspect of the invention, a toggle-link type hand tool is provided that includes pivotally interconnected elements having workpiece engaging members and a pair of handles each operatively connected to a respective one of the pivotally interconnected elements, and a toggle-link operatively connected between the handles. Additionally, each of the workpiece engaging members includes a self-adjusting jaw pivotally connected thereto and each jaw is configured to have an angle-shape for engagement with two adjacent sides of a hexagonal fastener. Additionally, the pivotable connection of at least one of the self-adjusting jaws to a respective workpiece engaging member may be provided by a slot formed in one of the jaw and the member and a pin fixed to the other of the jaw and the member to provide greater adjustability of the jaws.

According to a further aspect of the invention, a toggle-link type hand tool is provided that includes pivotally interconnected elements having workpiece engaging members, a pair of handles, with each of the handles operatively connected to a respective one of the elements, and a toggle-link operatively connected between the handles. Furthermore, each of the workpiece engaging members is configured to have a cutting surface, and the cutting surfaces may be configured as straight blades or the cutting surfaces may be configured as curved cutting surfaces to facilitate cutting of circular members.

In accordance with a further aspect of the invention, a toggle-link type hand tool includes first and second elongated elements, a pair of workpiece engaging members pivotally connected to the first elongated member, and the second elongated member forms a handle pivotally connected to one of the workpiece engaging members. Additionally, a first toggle-link is operatively interconnected between the first and second elongated elements and actuating mechanism for the other of the workpiece engaging member. Thus, manipulation of the handle and operation of the actuating mechanism causes the workpiece engaging members to move toward and away from one another to facilitate engagement with the workpiece. The actuating mechanism may include an operating mechanism operatively interconnecting the pair of workpiece engaging members for conjoint movement. Furthermore, the operating mechanism may include a gear segment formed on each of the workpiece engaging members, with the gear segments meshing together so that movement of the one workpiece engaging member by operation of the handle transmits movement to the other workpiece engaging member for actuation thereof. Each workpiece engaging member may include a self-adjusting jaw pivotally connected thereto, and each of the jaws may be configured to have an angle-shape for engagement with two adjacent sides of a hexagonal fastener.

Furthermore, the workpiece engaging members may be provided with toothed segments to provide a firm grip on workpieces engaged thereby. Moreover, the actuating mechanism may include a third elongated element forming a second handle pivotally connected to the other of the workpiece engaging member, and a second toggle-link may be operatively connected between the first and third elongated elements. Moreover, the first and second toggle-links may be each pivotally connected at a first end to the respective second and third elongated elements and may be each connected at a second end to the first elongated member for pivotable and longitudinal movement relative thereto.

The first elongated element may be formed from a pair of spaced apart, complementary curved plates forming an elongate passageway in which the second ends of the toggle-links are pivotally and longitudinally moveable. The second ends of the toggle-links may each be provided with two semi-spherical members, on opposite sides thereof, for permitting the pivotable and longitudinal movement within the passage.

According to another aspect of the invention, the toggle-link hand tool may further include an adjustment member on the first elongated element for engagement by the second ends of the toggle-links, thereby providing adjustability for the workpiece engaging members. Furthermore, the adjustment member may be formed as a screw-threaded member threadedly engaged with an outer end of the first elongated element, and an end of the screw-threaded member may engage the second ends of the toggle-links to provide adjustability. Furthermore, the second ends of the toggle-links may be pivotally interconnected, and two semi-spherical members may be provided on opposite sides of the second ends of the toggle-links for permitting the pivotable and longitudinal movement within the passage. Furthermore, an adjustment member may be provided on the first element for engagement by the second ends of the toggle-links to provide adjustability for the workpiece engaging members, and the adjustment member may be formed as a screw-threaded member threadedly engaged with an outer end of the first element and an end of the screw-threaded member engages the second ends of the toggle-links.

According to a further aspect of the invention, the toggle-link type hand tool may be formed such that the second and the third elongated elements are longer than, and extend outwardly beyond, an outer end of the first elongated element to increase the leverage of the hand tool, to permit operation of the hand tool by two hands, and to eliminate the need for a release lever for the locking mechanism. Each workpiece engaging member may also include a self-adjusting jaw pivotally connected thereto, and each jaw may be configured to have an angle-shape for engagement with two sides of a hexagonal fastener. Alternatively, each of the workpiece engaging members may be configured to have a cutting surface, and the cutting surfaces may be configured as straight blades or as curved cutting surfaces.

According to a further aspect of the invention, each of the workpiece engaging members may have an arcuate configuration, and a plurality of teeth may be provided on facing inner arcuate surfaces of the workpiece engaging members to facilitate gripping of a workpiece having a generally circular outer surface.

BRIEF DESCRIPTION OF THE DRAWINGS

The above and other features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 2:
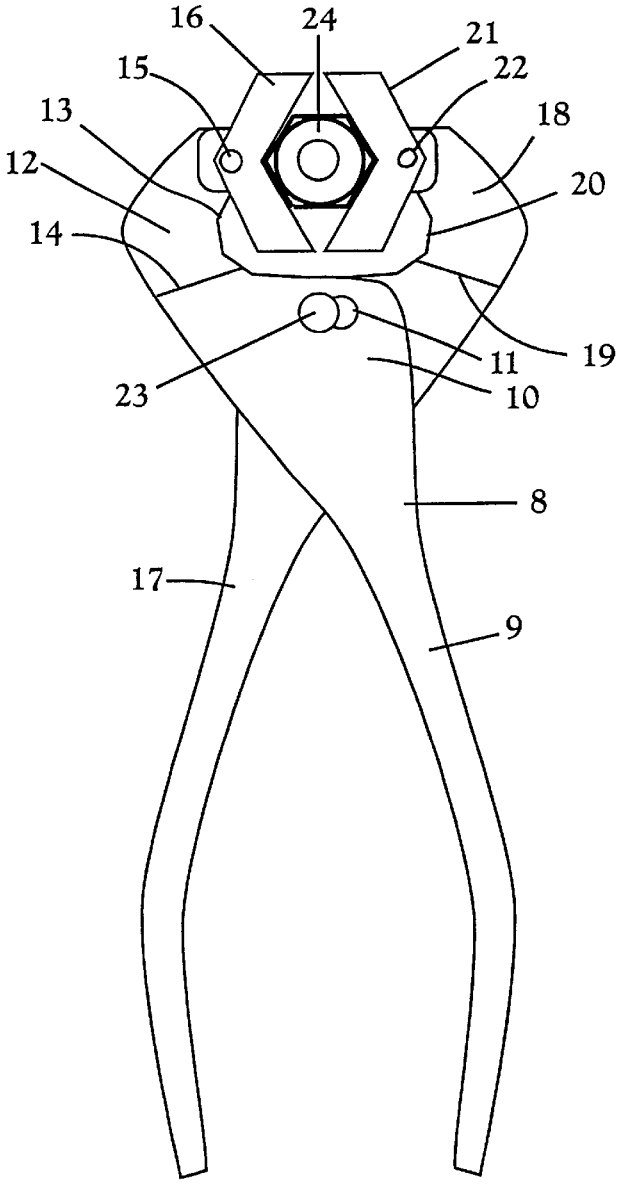
FIG. 2 is a side elevation view of a first embodiment of the hand tool according to the present invention having a slip joint.

Referring to FIG. 2, a first embodiment of the hand tool according to the invention is depicted as slip joint pliers 8. The pliers 8 are formed from a first elongated member including a right handle 9, a plate-like body 10 and a left jaw 12. A second elongated member includes a left handle 17, a plate-like body (not numbered), and a right jaw 18. The left and right jaws 12,18 are offset with respect to the plate-like bodies to which they are connected at portions 14,19, respectively, to permit the outer ends of the jaws to directly oppose one another. The plate-like body portions are pivotally interconnected by a slip joint provided by adjusting notches 11 formed in the plate-like body 10 and a pin 23 connected to the plate-like body of the other elongated member, and the pin 23 extends through the adjusting notches 11 in a conventional manner to allow two-position adjustability of the slip joint pliers. As can be seen from FIG. 2, a left-side self-adjusting jaw 16 is pivotally mounted by a hinge pin 15 to the outer end of left jaw 12, and a right-side self-adjusting jaw 21 is pivotally mounted via hinge pin 22 to the right jaw 18. The left S jaw 12 is configured to provide a recess 13 to accommodate pivotal movement of the left-side adjusting jaw 16 and the right jaw 18 is configured to provide a recess 20 to accommodate the pivoting movement of the right-side self-adjusting jaw 21.

Figure 1:
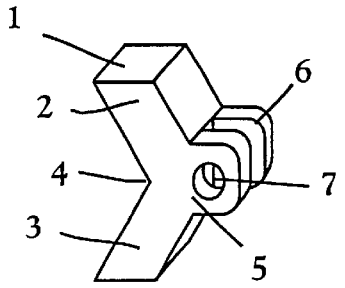
FIG. 1 is a perspective view of a self-adjusting jaw utilized in accordance with the present invention.

A self-adjusting jaw 1, which is representative of the self-adjusting jaws utilized throughout this disclosure, is depicted in FIG. 1. Each self-adjusting jaw 1 includes two diverging angular side portions 2,3 that extend at an angle of about 120° and intersect at an apex 4. The angular relationship of the side portions 2,3 is configured such that both side portions 2,3 fully engage along two adjacent sides of a hexagonal bolt head or nut 24 as seen in FIG. 2. Thus, the opposed left-side and right-side self-adjusting jaws 16,21 are substantially opposed to one another and they self-adjust about the respective pivot pins 15,22 to closely engage opposite sides of the bolt head or nut 24 as shown in FIG. 2 to permit a strong gripping force to be applied to the fastener and to reduce the likelihood that the comers of the fastener may be rounded off. Furthermore, if the comers of the fastener have been rounded or damaged previously, the positive engagement of the self-adjusting jaws along opposed sides of the fastener will enable sufficient torque to be applied thereto to effect rotation of the fastener. Additionally, the self-adjusting jaw 1 as depicted in FIG. 1 includes outwardly extending hinge portions 5,6 each having an aperture 7 for receipt of a respective hinge pin 15,22 for pivotally mounting the self-adjusting jaw on the associated jaw member. The self-adjusting jaws and the hinge pins may be formed of any suitable material including metal, such as steel, and preferably may be formed of a spring steel alloy having a hardness range of about 59 to 61 Rockwell C.

Figure 3:
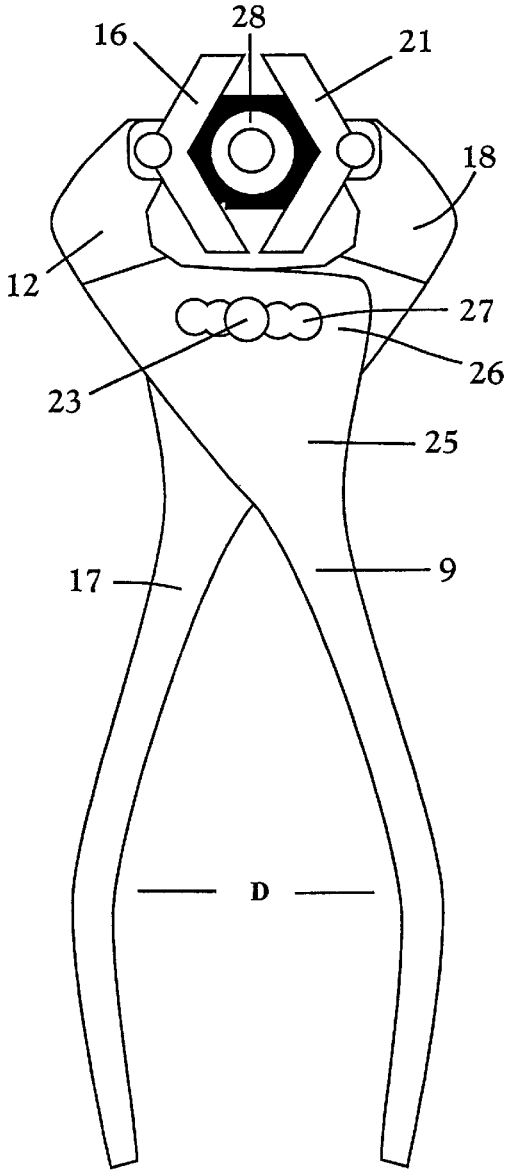
FIG. 3 is a side elevation view of a second embodiment of the hand tool of the present invention having a slip joint.

FIG. 3 of the drawings illustrates another embodiment of the hand tool according to the invention which is formed as a pair of slip joint pliers 25. In this figure like parts are designated with the same reference numerals as those utilized in the embodiment depicted in FIG. 2, and the essential difference is that the plate-like body 26 is formed to have a greater lateral expanse than that of the hand tool depicted in FIG. 2 to accommodate an extended series of adjacent notches 27. Thus, the pin 23 can be positioned in a desired notch to allow the self-adjusting jaws 16,21 to accommodate fasteners having a variety of sizes while maintaining the distance (D) between the handles 17,9 (as shown in FIG. 3) to be at a minimum. With this arrangement, the series of notches 27 permits the slip joint tool 25 to accommodate larger work pieces such as the bolt 28 depicted in FIG. 3.

Another embodiment of the hand tool according to the invention will now be described with reference to FIGS. 4–7 which illustrate slip joint pliers 29. This embodiment includes larger plate-like bodies 26,33 respectively on the right and left side of the elongate members, and each plate-like body has an elongate series of adjacent notches 35,36 which, in the assembled and operative position, are superposed and interconnected by a loose pin 37. The outer ends of the elongated members forming the split joint pliers 29 are provided with conventional jaw members 32,34.

Figure 5:
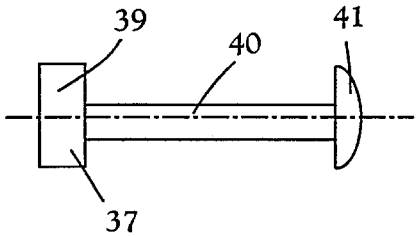
FIGS. 5 and 6 show a side elevation view, and a cross-sectional view, respectively, of the connecting pin utilized in the embodiment of FIGS. 3 and 4.
Figure 6:
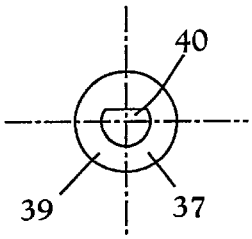

The loose pin 37 is illustrated in FIGS. 5 and 6 and is configured as a rod member 40 having a D-shape cross-section (FIG. 6) and includes a stopper end 41 at one end of the rod and a knurled knob 39 at the other end of the rod. Alternatively, the pin 37 may be provided with a pair of knurled knobs, one positioned at each end of the rod 40 (not shown).

Figure 4:
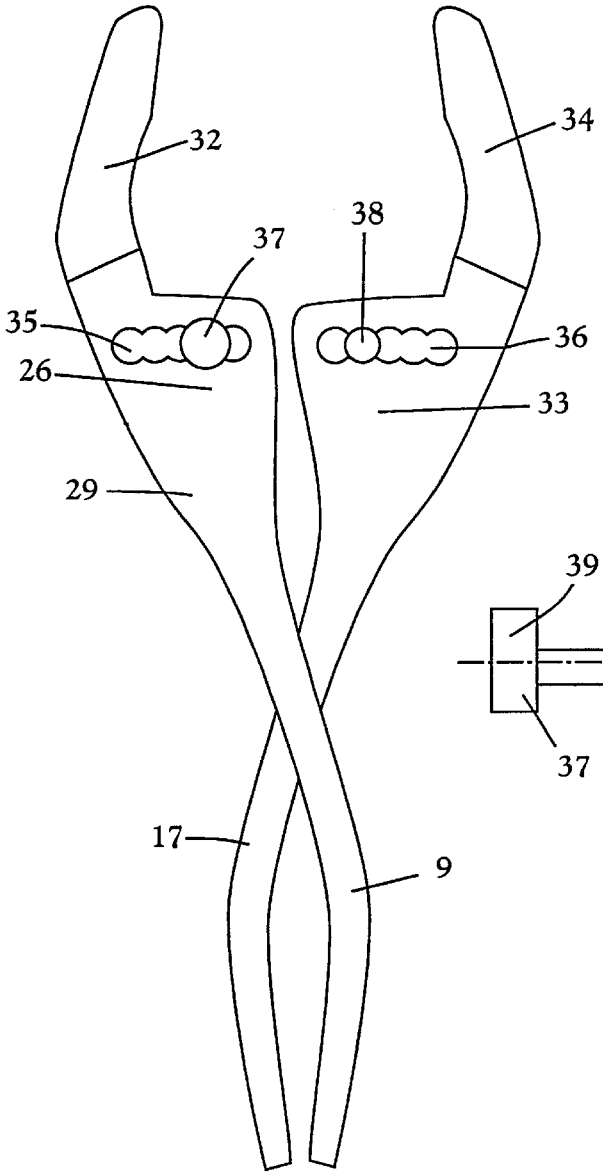
FIG. 4 shows the hand tool of the embodiment of FIG. 3 with the handles separated for clarity.
Figure 7:
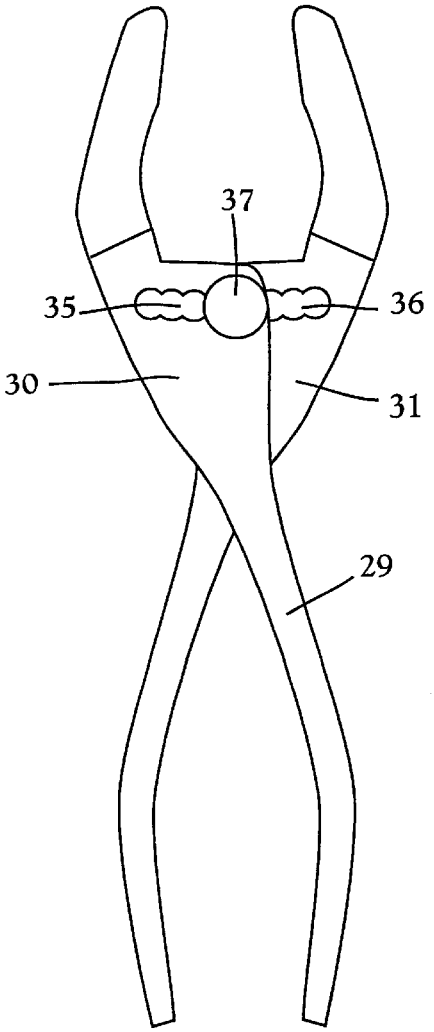
FIG. 7 is a side elevation view of the embodiment of FIG. 4 showing one adjusted position of the pivoted handles.

The circle 38 shown in FIG. 4 depicts one position of the rod 40 in the series of notches in order to provide a pivotal connection between the respective elongate members forming the tool 29. In order to adjust the position of the handle 17,9 and the respective jaws 32,34, the loose pin 37 is moved to the appropriate one of the series of notches. This is accomplished by manually grasping the knurled knob 39 and rotating the pin 40 such that the flat side of the D-shaped rod is aligned with the longitudinal extension of the series of notches 36 to allow the movement of the rod 40 from one notch to another in the series of notches 35 or the series of notches 36 or in both series of notches 35 and 36 either alternatively or simultaneously. Once the rod 40 is positioned in the appropriate notch or notches, the knurled knob 39 is rotated to a position prohibiting movement of the pin from the selected notches while permitting pivotal movement between the elongated members. It is apparent that the elongated series of notches 35,36 and the cooperating loose adjusting pin 37 provide an even greater adjustability to the jaw openings and allows the handles 9,17 to maintain a minimum distance of separation therebetween while accommodating the various sized fasteners or workpieces between the jaws 32,34. This permits the user to easily hold and squeeze the handles to apply a maximum gripping force to the fastener or workpiece. FIG. 7 is a side elevational view of the hand tool of this embodiment wherein the overlapping elongated series of notches 35,36 are shown engaged by the loose adjustment pin 37 at the ends thereof, which provides the greatest jaw opening distance.

Figure 8:
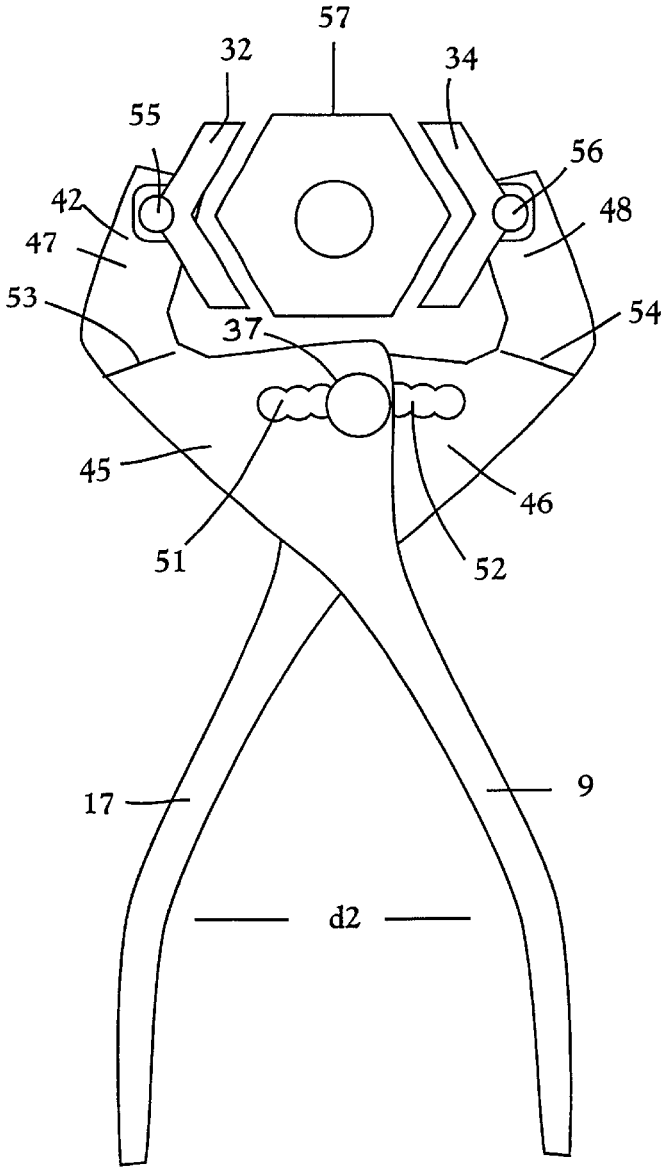
FIG. 8 is a side elevation view of the embodiment of FIG. 3 showing a different adjusted arrangement of the pivoted handles.

FIG. 8 illustrates an alternative embodiment of split joint pliers 42 similar to that shown in FIGS. 4-7. However, this embodiment includes larger plate-like bodies 45,46 and more robust left and right jaws 47,48 which are offset at 53,54, respectively such that the jaws 47,48 substantially oppose one another. Self-adjusting jaws 32,34 are pivotally connected to the respective jaw members 47,48 by pins 55,56. The self-adjusting jaws and the hinge pins may be formed of any suitable material including metal, such as steel, and preferably may be formed of a spring steel alloy having a hardness range of about 59 to 61 Rockwell C. Again, the plate-like body 45 is provided with an elongate series of notches 51 and the plate-like body 46 is provided with an elongate series of notches 52 which overlap with one another in the operative position, and the elongate members are pivotally interconnected by a loose pin 37 in the same manner as described with respect to FIGS. 4–7. Thus, the hand tool according to this embodiment can accommodate a large size fastener head 57 in a self-adjusting manner, and due to the adjustability provided by the loose pin 37 and the overlapping elongate series of notches, the spacing d2 between the handles 17,9 can be maintained at a minimum to provide the greatest leverage possible as well as to secure engagement of the fastener 57 by the self-adjusting jaws.

Figure 9:
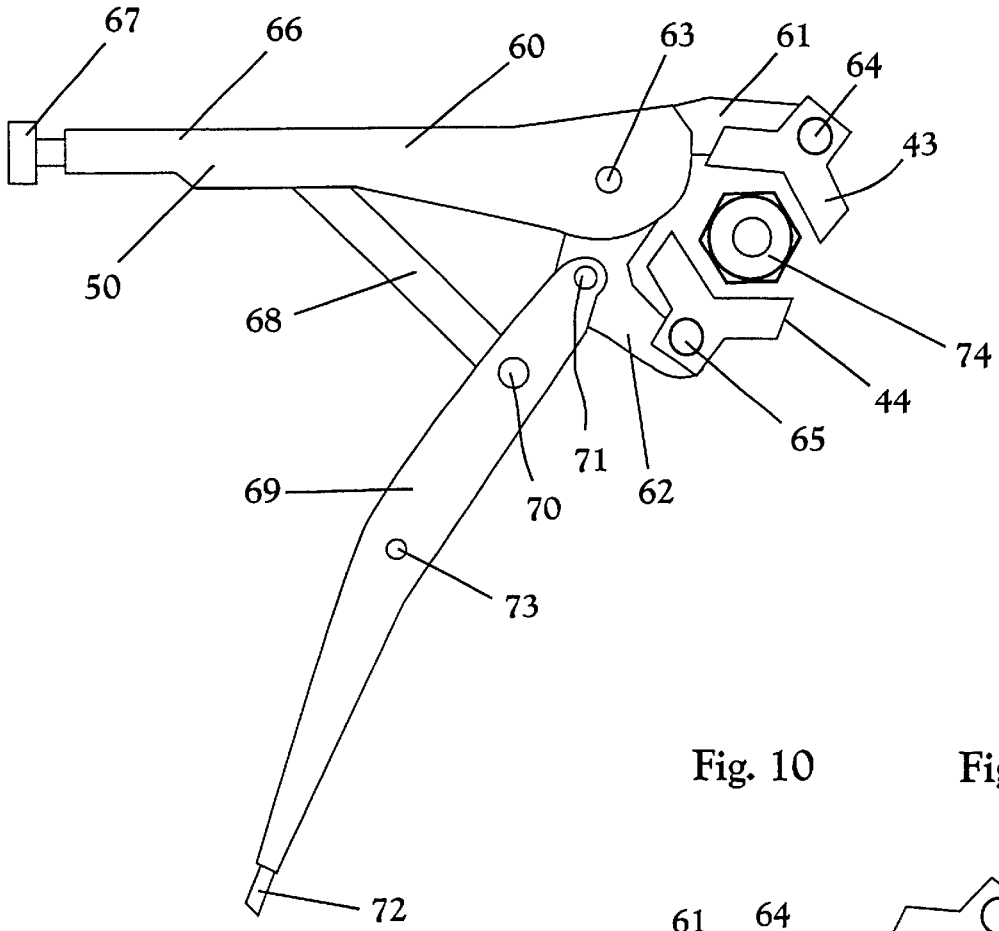
FIG. 9 is a side elevation view of a toggle-link type hand tool in accordance with the present invention and including a pair of self-adjusting jaw members.

FIG. 9 depicts a hand tool according to the present invention which is configured as a toggle-link type hand tool of the type generally called locking pliers which are well known in the art. Thus, it is not deemed necessary to explain in detail the functioning of the known toggle-link arrangements and reference is made only to the relevant parts incorporating the novel features in accordance with the present invention.

Accordingly, locking pliers 60 include a first handle 66 having a fixed jaw 61 rigidly connected thereto and a movable jaw 62 pivotally connected to the handle 66 by pivot pin 63. Fixed jaw 61 and movable jaw 62 each have self-adjusting jaws 43,44 respectively pivotally connected thereto via hinge pins 64,65. The self-adjusting jaws and the hinge pins may be formed of any suitable material including metal, such as steel, and preferably may be formed of a spring steel alloy having a hardness range of about 59 to 61 Rockwell C. A movable handle 69 is pivotally connected at one end to the movable jaw 62 by a pivot pin 71, and a toggle-link 68 is pivotally connected at one end by the hinge pin 70 intermediate the ends of the movable handle 69 and is operatively connected to the handle 66 at its other end in a conventional manner.

The outer end of handle 66 is provided with an adjusting screw 67 for engagement with the toggle-link 68 to provide the adjustable positioning of the fixed jaw and movable jaw relative to one another, and the movable handle 69 includes a release lever 72 pivotally connected thereto by a pivot pin 73 for operation in a conventional manner. Accordingly, the self-adjusting jaws 43,44 are configured to automatically align with opposed pairs of sides of a hexagonal workpiece, such as the fastener 74 depicted in FIG. 9. This arrangement provides more secure engagement by the jaws of the locking pliers to permit a strong gripping force to be applied to the fastener and to allow a more effective application of force or torque to a fastener or a workpiece which reduces the likelihood that the comers of the fastener will be rounded off during application of the torque. Furthermore, by use of the adjusting screw feature of the locking pliers 60, the self-adjusting jaws can be properly positioned to provide the proper distance between the jaws 61,62 in order to apply a more effective gripping force and torquing force.

Figure 10:
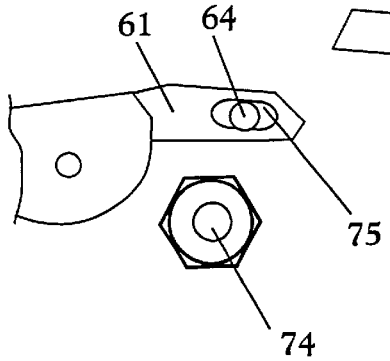
FIGS. 10 and 11 are side elevational views of elements of the connection between the self-adjusting jaw member and the toggle-link type hand tool.
Figure 11:
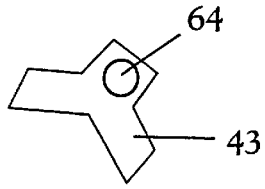

Additionally, as can be seen from FIG. 10, the fixed jaw member 61 of the locking pliers 60 may be provided with a longitudinally extending slot 75 which receives the hinge pin 64 of the self-adjusting jaw 43. Thus, during operation of the locking plier 60, the hinge pin 64 can move lineally within the longitudinal slot 75 to provide better alignment of the self-adjusting jaw members 43,44 to more accurately and completely engage the opposed pairs of sides of the hexagonal fastener to be gripped therebetween. FIG. 11 is a depiction of the self-adjusting jaw 43 removed from its application to the fixed jaw 61.

Figure 12:
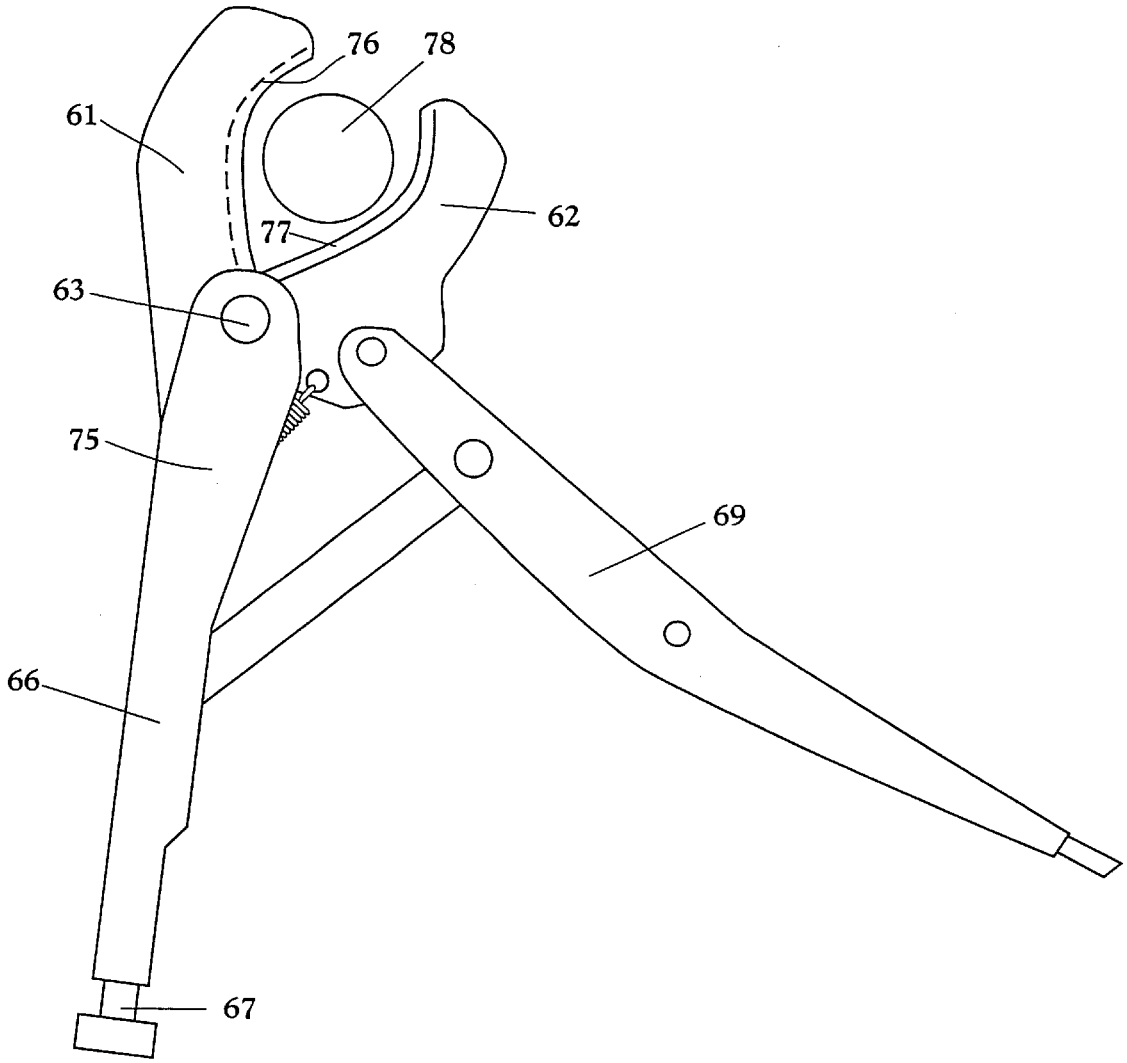
FIGS. 12 and 13 depict toggle-link type hand tools of the present invention having curved and straight cutting jaw portions, respectively.

FIG. 12 illustrates another embodiment of locking pliers 75, in which like elements in FIG. 12 are represented by the corresponding reference numerals previously indicated with respect to FIG. 9. In this embodiment, the fixed jaw 61 and the movable jaw 62 are each provided with respective cutting edges 76,77 for cutting a workpiece such as a cable 78. The plane of pivoting of the movable jaw 62 is slightly offset from the plane of the fixed jaw 61. During the operation of the locking-pliers 75, in order to cut a workpiece, such as a cable 78, the cutting operation is performed in successive stages during which the movable jaw is closed to engage and cut a portion of the cable 78 by operation of the handle 69, after which the movable jaw is released and the adjustable screw 67 is progressively tightened after each cutting stroke so that the jaws 61 and 62 move progressively closer to one another until the workpiece is completely cut. Furthermore, the locking pliers 75 can be utilized to cut through the insulation coating on the various types of electrical wires and cables, or the like, in order to strip or peel off the insulating coating.

Figure 13:
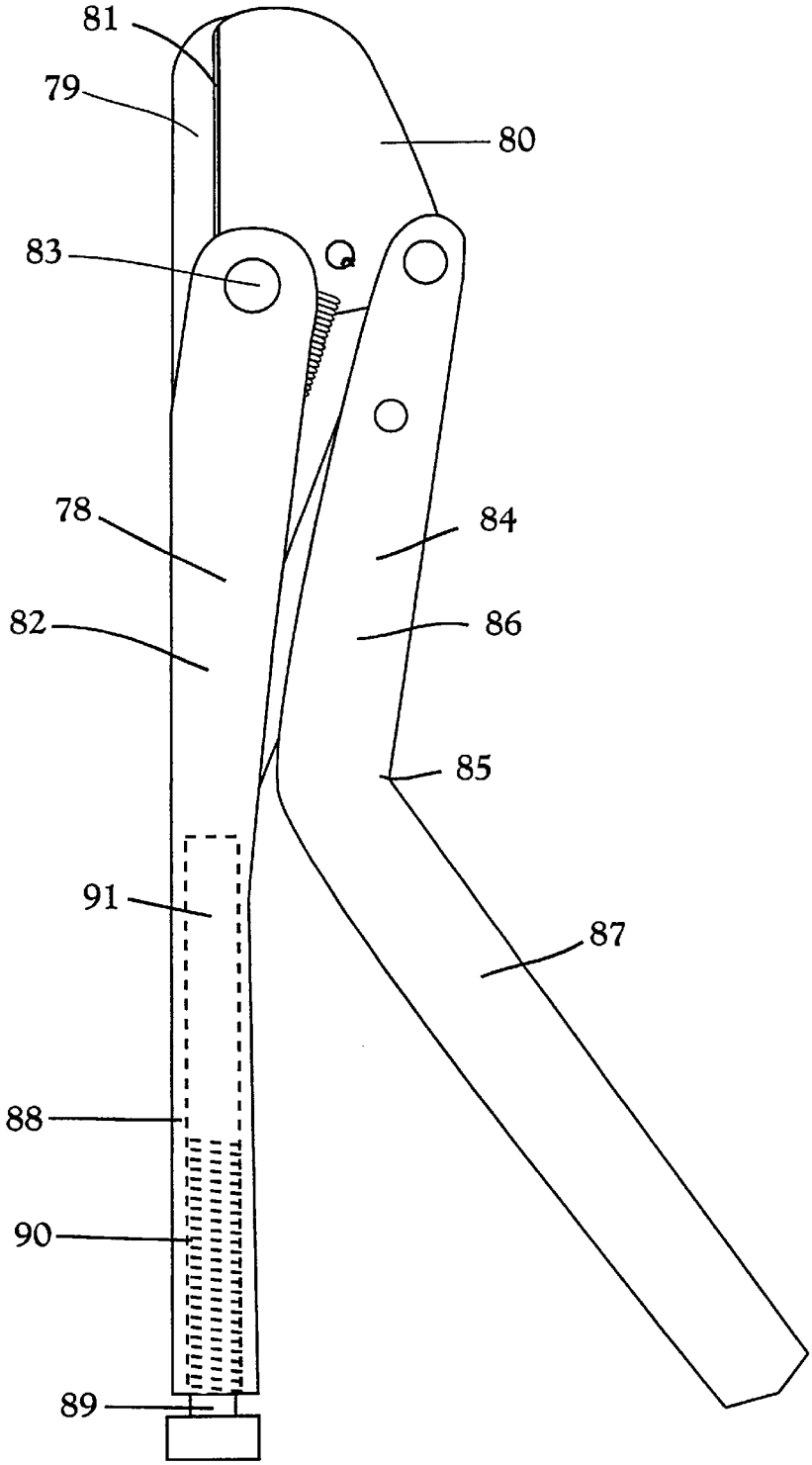

Another embodiment of locking pliers is illustrated in FIG. 13 wherein a pair of locking pliers 78 configured to be operated with both hands is depicted. The locking pliers 78 includes a fixed handle 82 having a fixed jaw 79 connected thereto. A lower fixed handle portion 88 receives an adjustment screw 89. The adjustment screw 89 has an extended length, and includes a threaded portion 90 and an unthreaded portion 91. A movable jaw 80 is pivotally connected to the fixed handle 82 by a hinge pin 83, and a movable handle 84 is pivotally connected to both the movable jaw 80 and a toggle-link in a conventional manner. The movable handle 84 is offset at 85 to provide an upper movable handle portion 86 and a lower movable handle portion 87 extending at an angle thereto. During operation of the locking pliers 78, the lower fixed handle portion 88 is grasped by one hand of an operator and the lower movable handle portion 87 is grasped by the other hand for movement toward and away from one another which results in the movable jaw 80 moving toward and away from the fixed jaw 79. The fixed and movable jaw 79 and 80 are each provided with straight, scissors-like blades, only one of which is shown for movable jaw 80 at 81. Due to the extended length of the fixed handle 82 and the movable handle 84, and the two hand operation thereof, no release lever is provided since none is necessary. Locking pliers 78 are particularly useful for cutting thick and relatively hard material, such as sheet metal and the like. The cutting operation for such material may be performed by successive cutting strokes, with or without changing the position of the adjustment screw 89.

Figure 14:
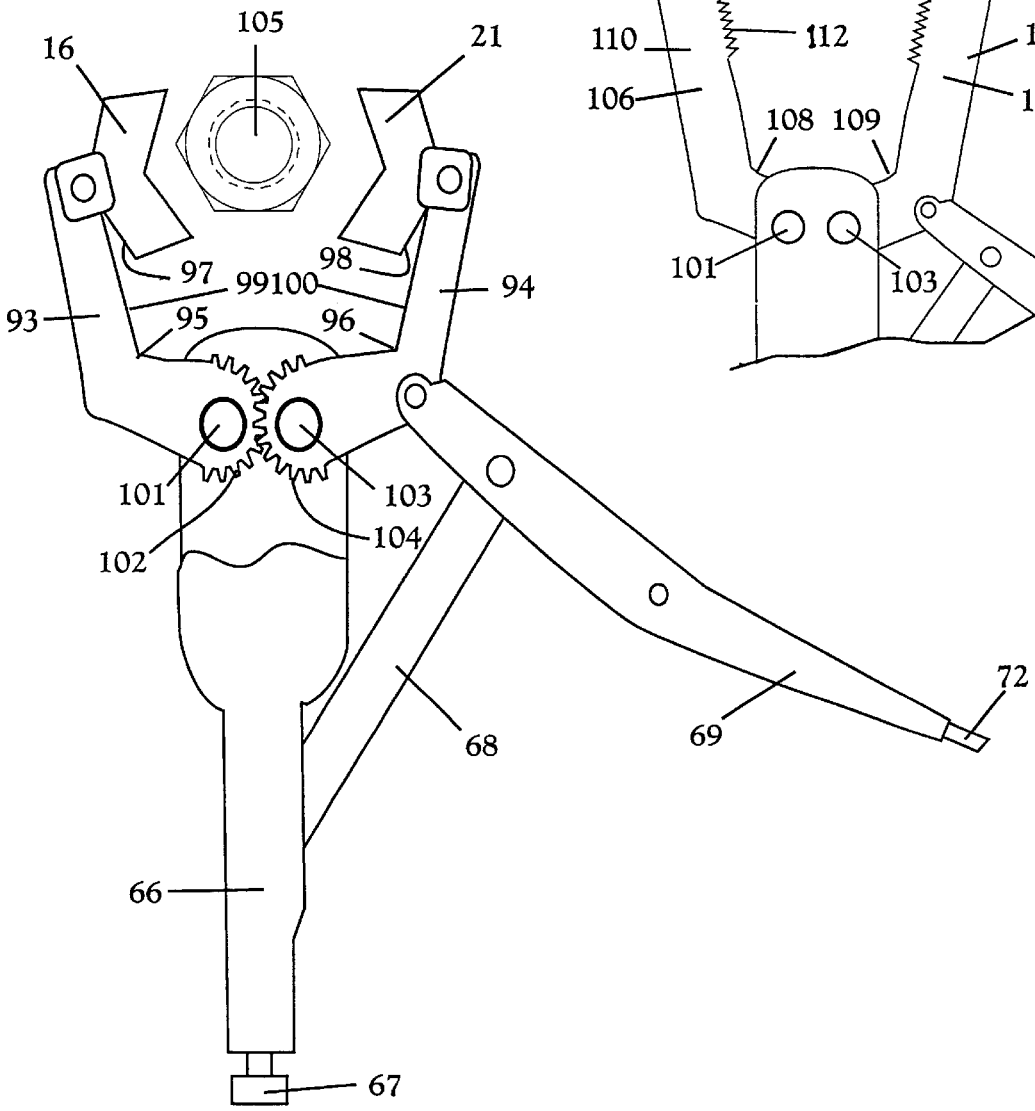
FIG. 14 depicts another embodiment of the toggle-link type hand tool in accordance with the present invention having gear segments operatively for interconnecting the jaw members for conjoint movement.

A further embodiment of locking pliers is illustrated in FIG. 14 incorporating additional features of the present invention. In this embodiment, a pair of movable jaws 93,94 are pivotally connected to a fixed handle 66 via respective hinge pins 101,103. Movable jaw 93 includes a gear segment 102 which meshes with a gear segment 104 provided on movable jaw 94. A movable handle 69 is pivotally connected to the movable jaw 94 and also to a toggle-link 68 which is pivotally connected to the movable handle 69 at one end and operatively connected to the fixed handle 66 at the other end such that movement of the movable handle 69 causes movement of the movable jaw 94 and, the meshing of the gear segments 102,104 results in conjoint movement of the movable jaw 93. Thus, it can be seen that operation of the movable handle 69 toward and away from the fixed handle 66 results in movement of both jaws 93,94 toward and away from one another.

The movable jaws 93,94 are provided with offset portions 95,96 respectively, and the outer ends of the movable jaws are each provided with a respective self-adjusting jaw 16,21. The offsets 95,96 permit pivotal movement of the self-adjusting jaws without engagement of the external bottom edges 97,98 of the self-adjusting jaws with the inwardly directed edges 99,100 of the movable jaws. The locking pliers of this embodiment, due to the conjoint movement of movable jaws 93 and 94 and the pivoting movement of the self-adjusting jaws 16,21, permit precise adjustment of the locking tool and complete engagement of the self-adjusting jaws with a hexagonal workpiece such as a fastener 105 to permit efficient application of a gripping force and a rotational force or torque thereto. This construction results in efficient application of a gripping force and a torque to the fastener without rounding the edges thereof, and also permits application of a torque to a fastener having previously rounded corners due to the engagement of the pair of flat jaw surfaces with opposite adjacent sides of the fastener.

Figure 15:
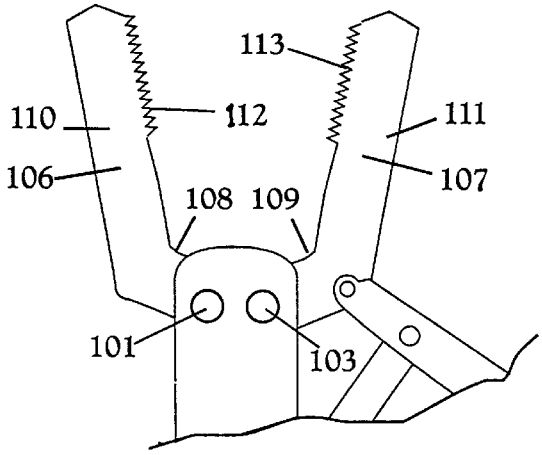
FIG. 15 depicts another embodiment of the toggle-link type hand tool of the present invention similar to that of FIG. 14, and having toothed jaw segments.

FIG. 15 illustrates a modification of the locking pliers depicted in FIG. 14 wherein corresponding elements have been labeled with corresponding reference numerals. In this embodiment, movable jaws 106,107 are pivotally connected to a fixed handle member for conjoint movement in the same manner as disclosed in the embodiment of FIG. 14. The movable jaws include offset portions 108,109, respectively, and generally straight upper portions 110,111. Movable jaw 106 is provided with a toothed portion 112 and movable jaw 107 is provided with a toothed portion 113. The toothed portions may be provided to have a reverse involute shape, or any other conventional tooth shape. The locking pliers of this embodiment having the toothed jaw portions can be advantageously utilized for gripping small objects therebetween.

Figure 16:
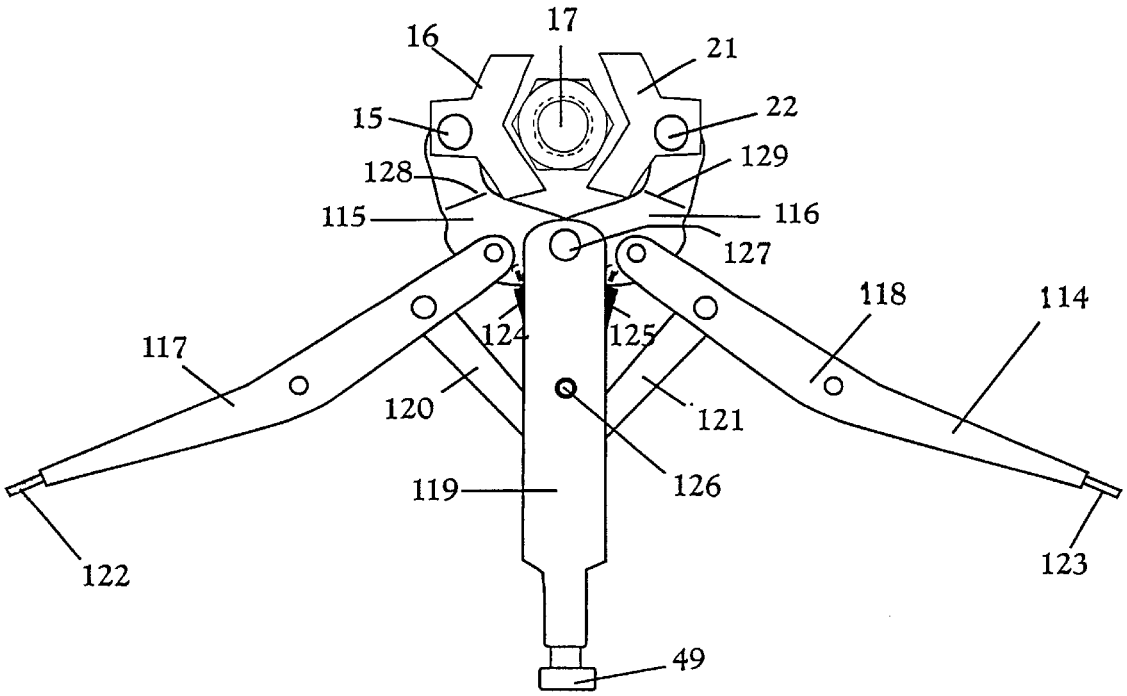
FIG. 16 depicts a side elevation view of another embodiment of the toggle-link type hand tool according to the present invention utilizing a pair of handle members.

FIG. 16 depicts a further embodiment of the hand tool according to the invention and in particular a locking pliers 114 provided with left and right symmetrical jaws 115,116 which are pivotally connected to a central handle 119 by a pivot pin 127. Left handle 117 is pivotally connected to left jaw 1 15 and a toggle-link 120 is pivotally connected at one end to the left handle 117 and operatively connected at the other end to the central handle 119. A right handle 118 is pivotally connected to the right jaw 116, and a toggle-link 121 is pivotally connected at one end to the right handle 1 18 and operatively connected at the other end to the central handle 119. Lateral springs 124,125 are respectively connected at first ends to a respective left and right jaw 115,116 and at their opposite ends to a pin 126. The left and right jaws 115,116 are each provided with offset portions 128,129, respectively, such that the outer ends of the respective jaws are diametrically opposed. The left jaw 115 is provided at the upper end thereof with a self-adjusting jaw 16 which is pivotally connected thereto by a pivot pin 15, and the upper end of the right jaw 116 has a self-adjusting jaw 21 pivotally connected thereto by a pin 22. The offset portions 128 and 129 permit the self-adjusting jaws 16,21 to move in substantially the same plane of motion. An adjustment screw 49 is provided at the outer end of the central handle 119 for adjustment of the toggle-links in the usual manner, and the outer ends of the handles 117,118 are respectively provided with release levers 122,123 which operate in a conventional manner. This configuration of locking pliers provides uniform and conjoint movement of the jaws 15,16 upon operation of the handles 117,118, and the self-adjusting jaws 16,21 are symmetrically positioned about the workpiece or hexagonal fastener 17 to enable a gripping force and a rotational force or torque to be applied efficiently thereto.

Figure 17:
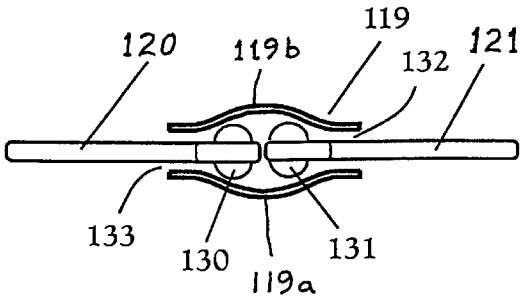
FIGS. 17–20 illustrate two variations of the interconnections of the toggle-links of the toggle-link hand tool according to the present invention.
Figure 18:
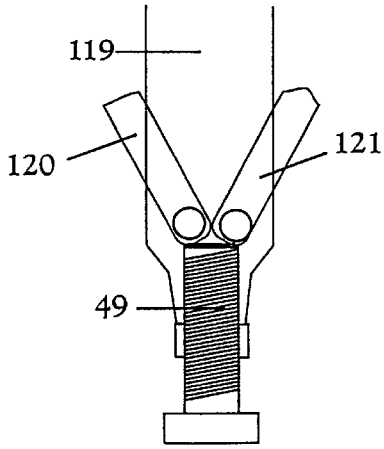

Details of the connection of the toggle-links 120,121 with the central handle 119 are shown in FIGS. 17 and 18. Referring to FIG. 17, which depicts a horizontal cross-section of the central handle 119, it can be seen that the central handle 119 is formed from a pair of spaced plates 119*a*, 119*b* that are curved outwardly and oppositely in the central region thereof to provide a longitudinal guide for the ends of the toggle-links 120,121. Toggle-link 120 is provided at one end with a pair of semi-spherical pieces 130 positioned on opposite sides, and toggle-link 121 is provided at one end with a pair of semi-spherical pieces 131 also positioned on opposite sides thereof, as can be seen in FIG. 17. It can also be seen from FIG. 17 that the pair of curved plates 119*a*; 119*b* forming the central handle 119 provides a pair of open sides 132,133 through which the toggle-links 120,121 extend, and the semi-spherical pieces 130,131 constrain the toggle-links for sliding longitudinally within the central handle and pivoting with respect thereto, but prevent the ends of the toggle-links from moving laterally through the open sides 132,133 of the central handle.

Turning to FIG. 18, it can be seen that the lowermost end of the central handle 119 is formed with a female threaded portion which receives adjustment screw 49. The ends of toggle-links 120,121 abut the flat top of the adjustment screw 49 and are urged toward this position by springs 124,125. It can be seen that adjustment of the adjustment screw 49 allows the locking pliers to accommodate heads of fasteners having various sizes in a manner to effect the desired clamping force on the head of the fastener.

Figure 19:
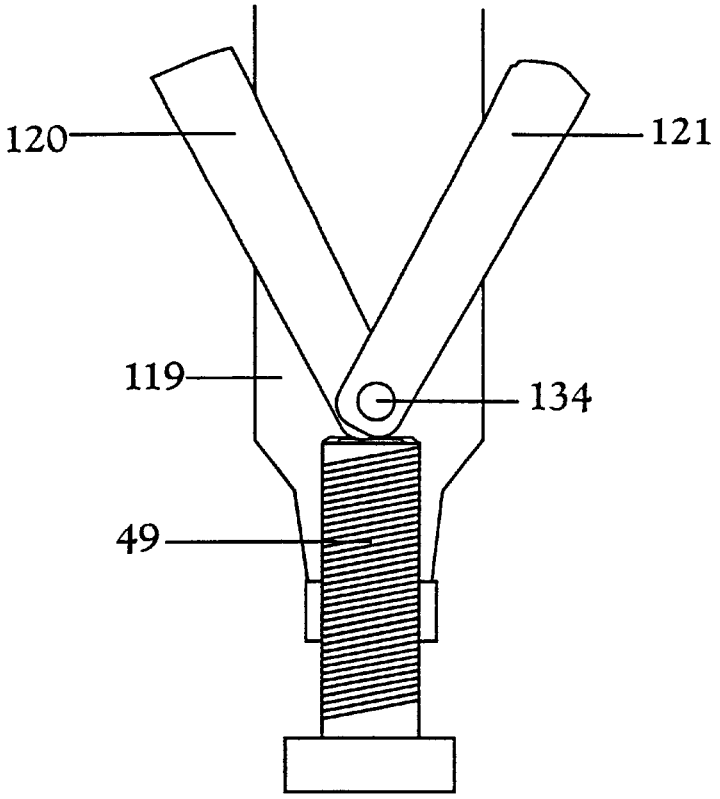
Figure 20:
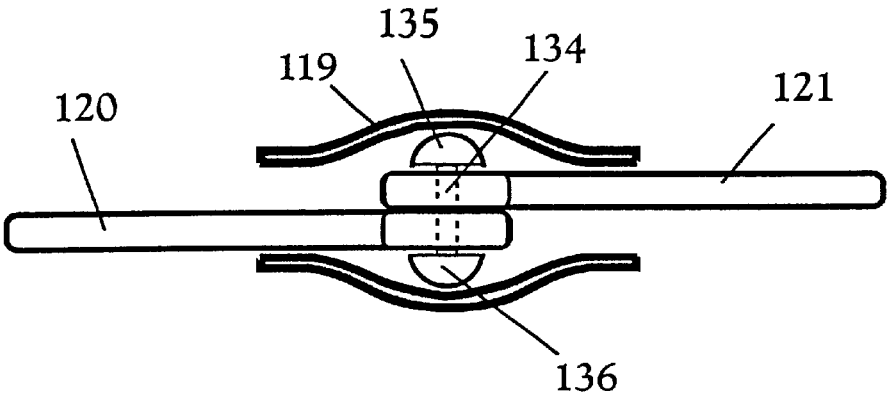

FIGS. 19 and 20 illustrate a modification of the connection of the toggle-links within the central handle 119. In this embodiment, the ends of the toggle-links 120,121 are pivotally interconnected by a pivot pin 134 which is formed with semi-spherical heads 135,136 on opposite ends thereof. In this manner, the semi-spherical heads constrain the toggle-link ends to longitudinal and pivotal movement relative to the central handle 119 while preventing lateral movement of the toggle-link ends out of the open sides. As can be seen from FIG. 19, the pivotally interconnected ends of the toggle-links 120,121 abut the flat top surface of the adjustment screw 49 and are biased into engagement therewith by the springs 124,125 (FIG. 16).

Figure 21:
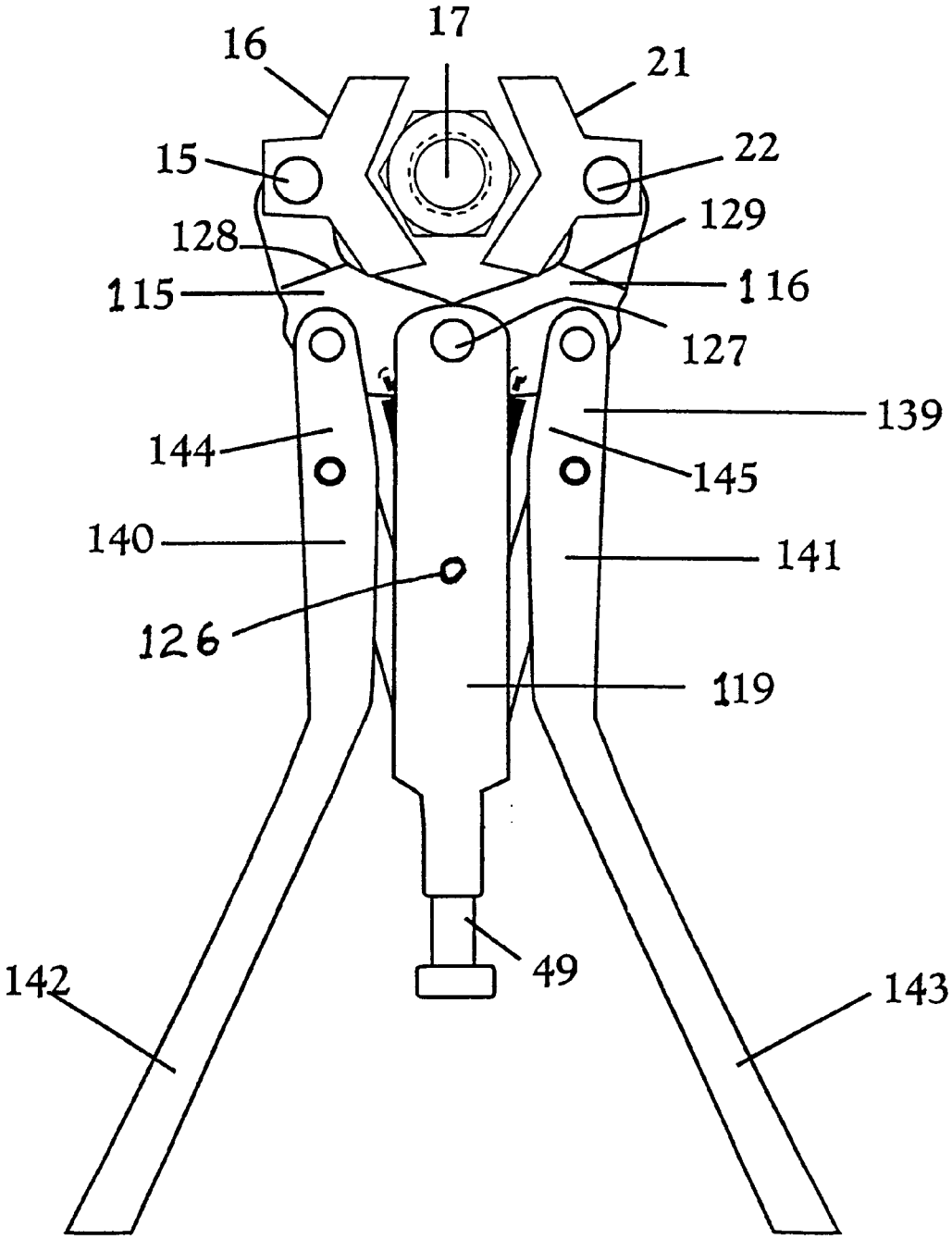
FIG. 21 is a side elevation view of another toggle-link type hand tool according to the present invention having a pair of elongated handles.

FIG. 21 depicts an alternative embodiment of the locking pliers shown in FIG. 16. This pair of locking pliers 139 is similar to that depicted in FIG. 16 except that the left and right handles 140,141 are longer and extend outwardly beyond the outer end of the central handle 119. Furthermore, the lower ends of 142,143 of the respective left and right handles diverge outwardly at an obtuse angle with respect to the upper portions 144,145. The increased length of the handles 140,141 permits operation of the locking pliers 139 with both hands by an operator and provides an increased mechanical advantage. Thus, the bottom gripping portion 142 can be grasped with one hand and the bottom gripping portion 143 can be grasped with the other hand to provide movement of the handles in opposite directions to operate the self-adjusting jaws 16,21 for engagement with a workpiece, such as the head of the fastener 17. Thus, not only do the longer handles provide a significant increase in the mechanical advantage of the locking pliers 139, but they also eliminate the need for release levers. The locking pliers 139 also include the self-adjusting jaws 16,21 as described with reference to FIG. 16.

Figure 22:
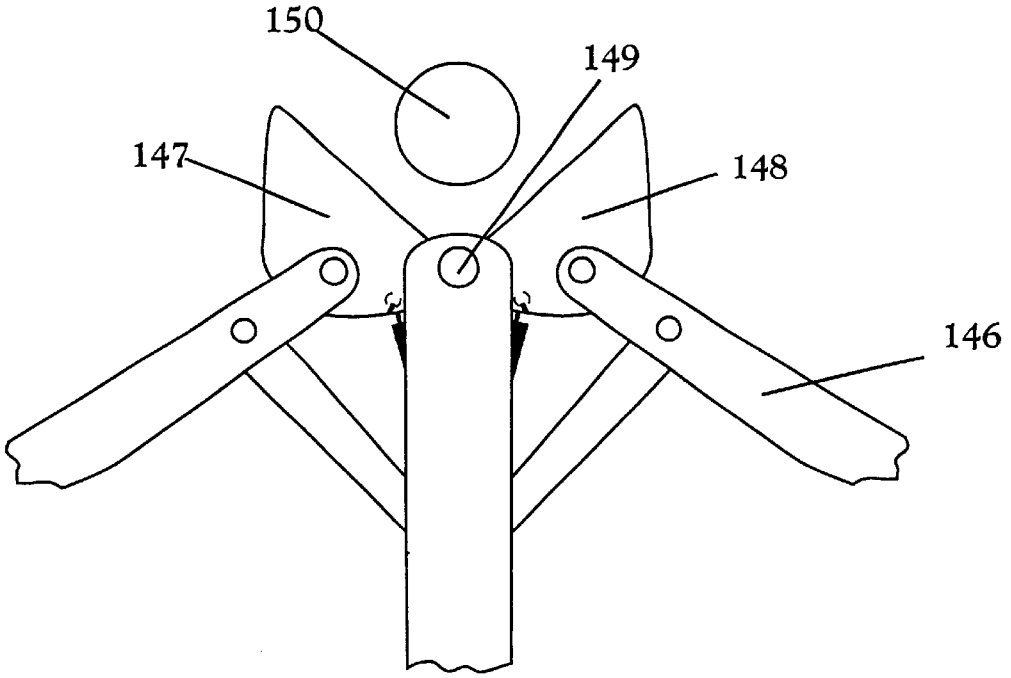
FIG. 22 and FIG. 23 illustrate further embodiments of the toggle-link type hand tool according to the present invention including jaws formed with cutting surfaces and arcuate grasping surfaces, respectively.

FIG. 22 shows a further alternative arrangement of the locking pliers depicted in FIG. 16. In this embodiment, the locking pliers 146 have a central handle and left and right handles as described with reference to FIG. 16. The locking pliers 146 are also provided with a pair of jaws 147,148, each of which include linear blade portions. Jaws 147,148 are pivotally interconnected to the central handle by a common pivot in 149 for movement toward and away from one another. The linear blade portions of the jaws 147,148 are suitable for cutting wires, cables, and the like, such as cable 150.

Figure 23:
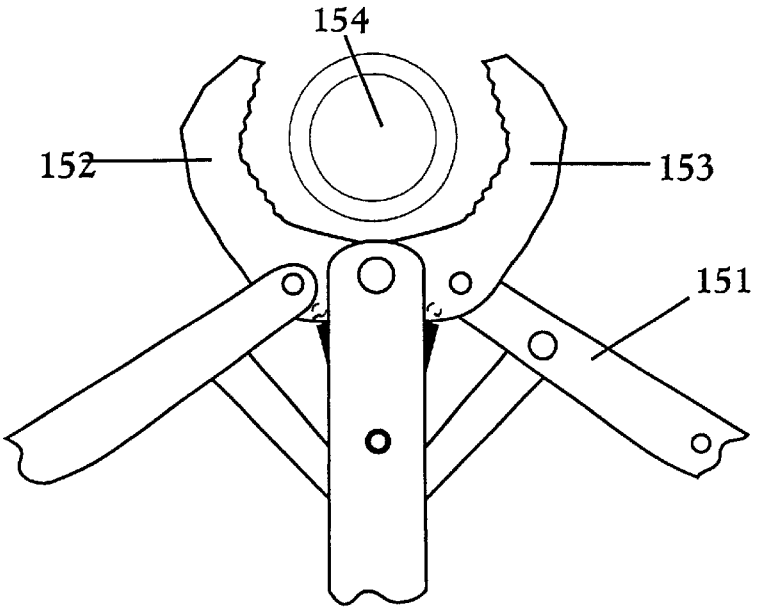

FIG. 23 shows a pair of locking pliers 151 similar to that depicted in FIG. 16 but which is provided with a pair of arcuately curved jaws 152,153. The inner surfaces of the arcuately curved jaws are provided with toothed portions to enable a firm gripping and holding of workpieces having generally circular cross-sections, such as tube 154.

Although the invention has been described with reference to particular means, materials, and embodiments, it is to be understood that the invention is not limited to the particulars disclosed and extends to all equivalence within the scope of the claims.

What is claimed:

1. A hand tool comprising:

at least two elongated members pivotably interconnected by a pivot joint to provide a pair of handles and a pair of jaw carrying members;

each said jaw carrying member including a self-adjusting jaw pivotably connected thereto;

each said self-adjusting jaw configured to have an angle-shape, such that operation of the handles causes engagement of a hexagonal fastener by said angle shaped jaws to enable imparting of a rotational force or torque thereto; and wherein each said angle-shaped jaw comprises a pair of flat jaw portions disposed at an angle of substantially 120° and configured to engage two adjacent sides of said hexagonal fastener.

2. A hand tool in accordance with claim 1, wherein said pivot joint is configured as a slip joint.

3. A hand tool in accordance with claim 2, wherein said slip joint comprises a slot formed in at least one of said elongated members, said slot having at least two adjusting notches therein, and a pin mounted on the other of said elongated members; said pin being movable within said slot from one adjusting notch to another, thereby permitting adjustment of jaw spacing to accommodate different size fasteners.

4. A hand tool in accordance with claim 3, wherein said slot is provided with more than two adjusting notches to permit greater adjustability of the hand tool.

5. A hand tool in accordance with claim 3, further comprising a second slot formed in the other of said elongate members, said second slot having at least two adjusting notches therein, and said pin is rotatably mounted and configured to have a D-shaped cross-section, whereby said pin is rotatable to align a flat side of the D-shape with a longitudinal dimension of each said slot to permit sliding movement of said elongate members relative to one another to provide adjustment and to position a curved side of said pin within respective notches to permit relative pivoting of said elongate handles to allow operation of the hand tool.

6. A hand tool in accordance with claim 5, further comprising a head on one end of said pin and a knurled knob on another end, said knurled knob facilitating rotation of said pin to a desired position.

7. A hand tool in accordance with claim 6, wherein each said slot is provided with more than two adjusting notches to permit greater adjustability of the hand tool.

* * * * *